US006785923B2

(12) United States Patent
Karafa et al.

(10) Patent No.: US 6,785,923 B2
(45) Date of Patent: Sep. 7, 2004

(54) INSTITUTIONAL BEDDING WITH INTEGRAL PILLOW AND MATTRESS

(75) Inventors: David M. Karafa, Granger, IN (US); Timothy W. Shelby, Osceola, IN (US)

(73) Assignee: Derby, Inc., South Bend, IN (US)

( * ) Notice: Subject to any disclaimer, the term of this patent is extended or adjusted under 35 U.S.C. 154(b) by 0 days.

(21) Appl. No.: 10/361,407

(22) Filed: Feb. 10, 2003

(65) Prior Publication Data

US 2003/0145387 A1 Aug. 7, 2003

Related U.S. Application Data

(63) Continuation-in-part of application No. 10/051,806, filed on Jan. 14, 2002, now Pat. No. 6,516,482, which is a continuation of application No. 09/340,288, filed on Jun. 28, 1999, now Pat. No. 6,351,864.

(51) Int. Cl.[7] ..... A47C 27/16
(52) U.S. Cl. ..... 5/733; 5/740; 5/699
(58) Field of Search ..... 5/733, 730, 722, 5/694, 731, 699, 740, 419, 420

(56) References Cited

U.S. PATENT DOCUMENTS

| | | | | | |
|---|---|---|---|---|---|
| 389,420 | A | | 9/1888 | Sutton | |
| 555,367 | A | | 2/1896 | Fraser | |
| 712,720 | A | * | 11/1902 | Richardson | 5/712 |
| 988,117 | A | * | 3/1911 | Leonard | 5/722 |
| 2,953,793 | A | | 6/1960 | Rossi | |
| 3,268,922 | A | | 8/1966 | Moxley | |
| 3,372,407 | A | | 3/1968 | Weber, III | |
| 4,006,503 | A | | 2/1977 | Wood | |
| 4,450,193 | A | | 5/1984 | Staebler | |
| 4,688,283 | A | * | 8/1987 | Jacobson et al. | 5/170 |
| 5,048,137 | A | * | 9/1991 | Rogers | 5/731 |
| 5,117,517 | A | | 6/1992 | Su | |
| 5,172,439 | A | * | 12/1992 | Farley | 5/722 |
| 5,224,226 | A | * | 7/1993 | Groenewald | 5/733 |
| 5,720,057 | A | | 2/1998 | Duncan | |
| 5,974,608 | A | | 11/1999 | Haller et al. | |
| 6,038,722 | A | | 3/2000 | Giori et al. | |
| 2002/0078507 | A1 | * | 6/2002 | Pearce | 5/644 |

OTHER PUBLICATIONS

Trotz, Bob, Drawing of Page Bedding, Chestnut Ridge Foam, Mar. 21, 1989, 1 page.
Morrison, Ray, CAD Drawing of Mattress with Built–In Pillow, Apr. 25,1996, 1 page.
Morrison, Ray, CAD Drawing of Mattress with Built–In Pillow, Jan. 31, 1993, 1 page.

* cited by examiner

*Primary Examiner*—Michael F. Trettel
(74) *Attorney, Agent, or Firm*—Baker & Daniels

(57) ABSTRACT

A bedding arrangement is provided having a compressible foam mattress pad and compressible foam pillow pad integrated as a single bedding unit within a fluid resistant or impermeable cover whose seams are heat sealed together. Air ventilation through the cover and about the interior foam is permitted by a vent that restricts insect, article and fluid passage through the vent. By using foam of different densities and/or composition, optimum performance characteristics in terms of comfort and support can be obtained separately for the mattress portion and the pillow portion. By mounting two pillow pads within the cover, the bedding arrangement can be made reversible.

35 Claims, 5 Drawing Sheets

INSTITUTIONAL BEDDING WITH INTEGRAL PILLOW AND MATTRESS

This application claims priority from and is a Continuation-In-Part of application Ser. No. 10/051,806 filed Jan. 14, 2002 and issued as U.S. Pat. No. 6,516,482 on Feb. 11, 2003, and which is a continuation of and claims priority from U.S. application Ser. No. 09/340,288 filed Jun. 28, 1999 and issued as U.S. Pat. No. 6,351,864 on Mar. 5, 2002.

BACKGROUND AND SUMMARY OF THE INVENTION

The present invention relates to bedding used in correctional institutions, hospitals and the like, and, more particularly, to foam filled, plastic covered bedding for use as mattresses and pillows.

Various governmental and private institutions, such as jails, prisons, and hospitals, need to provide bedding to large numbers of persons simultaneously. This bedding typically must include a mattress and a pillow in order to provide proper support for the human body and head during rest. Previously, a wide variety of materials and assemblies have been used for this purpose, typically involving a fabric covering for the mattress and a fabric pillow case. The mattress and pillow have been formed from a variety of materials, but also typically involving a fabric covering sewn together at its seams.

Such arrangements have been satisfactory for many purposes, but do have certain disadvantages. When it is necessary to routinely clean and sanitize the bedding, the mattress cover and pillow case must be removed, separately washed, dried and then separately reinstalled. Since this process may take some time, days even in large institutions, additional mattress covers and pillow cases are typically installed during the interim, and the former items are cyclically placed into storage/inventory until the next cleaning. Since the fabrics used are often porous, if a fluid is spilled onto or applied to the mattress cover or pillow case, the fluid may penetrate to the underlying mattress or pillow, and that item may additionally need to be cleaned, sanitized (if possible) or replaced entirely, often at relatively high cost. Thus, the cyclical cleaning process can be labor intensive, slow and expensive, requiring a relatively high volume of components and stored inventory.

Also, some prior bedding materials have been particularly susceptible to interior contamination from insects, fluid (blood, water, oil and the like) borne bacteria and virus and/or destructive fluids. Various methods of reducing that risk have been suggested, but often involving expensive and/or elaborate material, construction arrangements and ventilation methods.

Further, since over time and continual use bedding does tend to wear out or become irreparably contaminated or destroyed, many institutions must keep a replacement supply of bedding and bedding coverings in inventory as well. Unfortunately, many prior bedding arrangements are relatively expensive and thick, requiring considerable storage space for this inventory, and bulky, being more difficult to handle.

Moreover, bedding used in correctional institutions is faced with additional, special difficulties. Previously, some inmates have modified pillows and similar severable bedding elements into hard, blunt weapons capable of killing and/or as shields and like accessories to violent action. Also, bedding seams have been opened by severing the threads which hold the fabric together in order to hide contraband inside the bedding. The seams can then be lightly closed by tape and other means to render the contraband easily accessible to the inmate, but not easily or quickly detectable by guards and facility inspectors. In addition, the bedding material itself and/or coverings for that bedding, such as seam thread and padding, has been removed by the inmates to make contraband items or weapons.

It has also been found that some inmates tend to abuse the bedding to a much greater degree than other users normally would, thereby significantly decreasing its usable life. For example, penetration of the bedding by the inmate's bodily fluids inadvertently or otherwise can cause unsanitary conditions and destructive rot to exist inside of the bedding, as well as increase the required instances of cleaning for the bedding exterior. Nonetheless, when such bedding is removed for security or disciplinary reasons or deteriorates to an unserviceable state, even allegedly at the inmate's own hand, the denial of proper bedding has been the source of expensive and time consuming litigation against the correctional facility by the inmate, regardless of the outcome of the litigation.

In other applications, articles have been suggested which employ an integrated mattress and pillow, particularly for recreational use on or about water, which are formed of compressible foam or a heat sealed bladder. In the former structures, however, air ventilation within the article and about the foam with fluid restriction at the same time has been lacking. In the latter structures, incidental punctures have rendered the article unusable.

Accordingly, it is an object of the present invention to provide an improved bedding arrangement. Other objects include the provision of a bedding arrangement that is:

a. durable and relatively inexpensive to manufacture and maintain;

b. convenient to clean, sanitize and inventory;

c. less susceptible to misuse and abuse;

d. comfortable and properly supportive of the user during rest; and e. more resistant to contamination.

These and other objects of the present invention are attained by the provision of a bedding arrangement having a compressible foam mattress pad and compressible foam pillow pad integrated as a single bedding unit within a fluid resistant or impermeable cover whose seams are heat sealed together. Air ventilation through the cover and about the interior foam is permitted by a vent that restricts insect, article and fluid passage through the vent. By using foam of different densities and/or composition, optimum performance characteristics in terms of comfort and support can be obtained separately for the mattress portion and the pillow portion. By mounting two pillow pads within the cover, the bedding arrangement can be made reversible.

Other objects, advantages and novel features of the present invention will now be readily apparent to those of ordinary skill in the art from the following drawings and description of preferred embodiments.

DETAILED DESCRIPTION OF PREFERRED EMBODIMENTS

Figure 1:
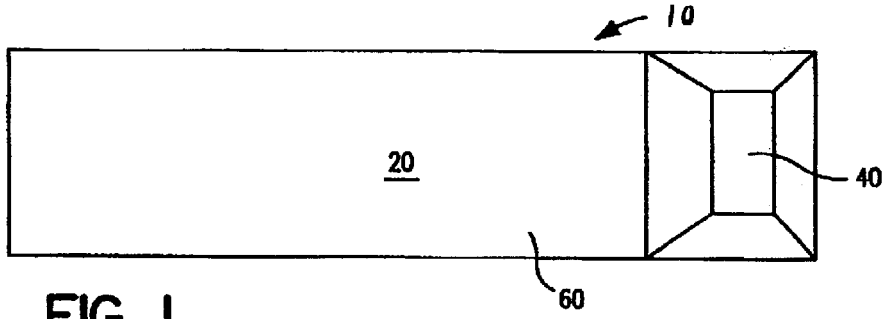
FIG. 1 shows a top plan view of a bedding arrangement according to the present invention.
Figure 2:
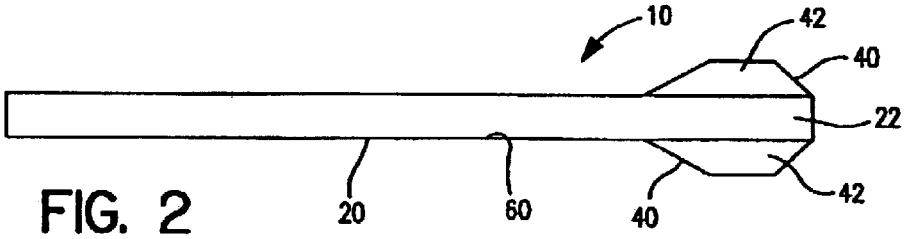
FIG. 2 shows a side view of the bedding arrangement of FIG. 1.
Figure 3:
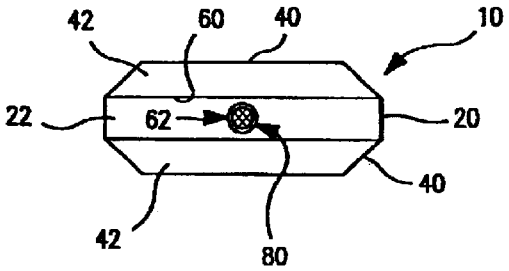
FIG. 3 shows a pillow end view of the bedding arrangement of FIG. 1.
Figure 4:
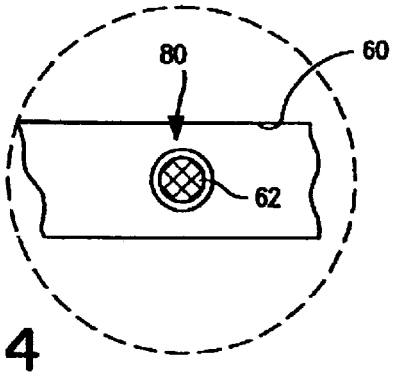
FIG. 4 shows an enlarged view of the vent portion of the bedding arrangement of FIG. 1.
Figure 5:
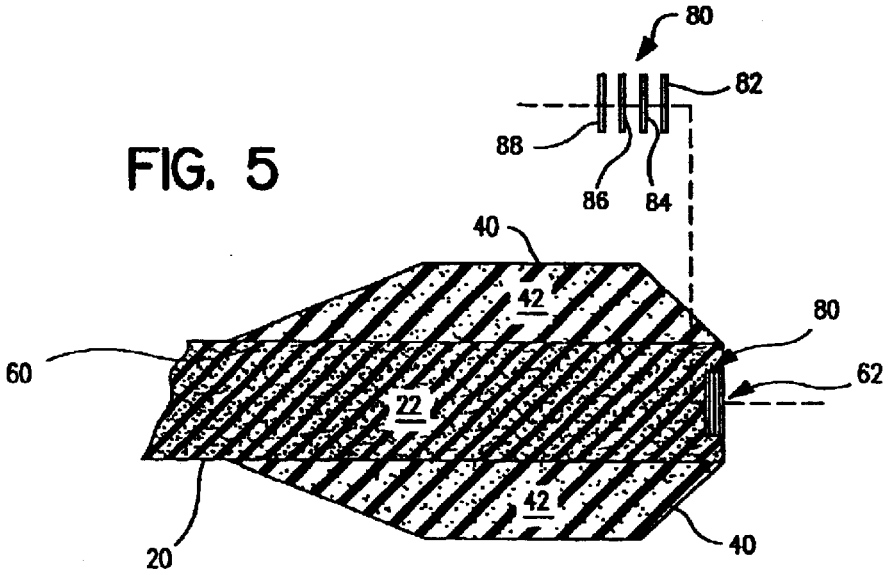
FIG. 5 shows an enlarged, cross sectional side view of a portion of the bedding arrangement of FIG. 1 with the vent components shown additionally exploded for ease of viewing, the enlargement not being exactly to scale of the enlargement of FIG. 4.

FIG. 1 shows a preferred embodiment of a bedding arrangement 10 according to the teachings of the present invention. Bedding arrangement 10 includes a mattress portion 20 and a pillow portion 40. Mattress portion 20 is formed from padding material 22 and sized into a body supporting dimension. Pillow portion 40 is formed from padding material 42 and sized into a head supporting portion. In the embodiment shown in the drawings, two pillow portions 40 are included on either side of one end of mattress portions 20. Preferably, these pillow portions are in fixed positions, with the end of mattress portion 20 sandwiched therebetween. However, it will be understood that if desirable in a given application, only a single pillow portion 40 may be used. An advantage of using two such pillow portions as shown is that it permits bedding reversibility, as will be understood more fully from the discussion below.

In one embodiment, the padding material for both portions is compressible urethane foam. It may be especially desirable to have different density or compressibility characteristics for padding 22 and padding 42 in order to optimize the comfort and support levels in each portion of the bedding arrangement for a particular application. For example, 18045 urethane foam could be used for padding material 22 with 18028 urethane foam used for padding material 42. Alternatively, densified polyester batting, silicone foam, neoprene foam, cotton batting or the like or combinations of those materials, or even a combination of foam with a polyester core could be used as the padding materials in the present invention, according to the desired results in a given application.

The dimensions of bedding arrangement 10 can also be as desired in a given application, although in preferred embodiments the overall length and width is recommended to be 75 inches and 25 inches, respectively, with the thickness of mattress portion 20 being 3 inches and the thickness of each pillow portion 40 being 2 inches. Similarly, recommended pillow dimensions are 12.25 inches long by 25 inches wide. It will be understood that the proportions of these features in the drawings are only very roughly drawn to this scale as the exact dimensions are not critical to the applicability and function of the present invention.

Covering 60 surrounds mattress portion 20 and pillow portions 40 simultaneously and integrates them into a single unit that is inseparable under normal use. Covering 60 is preferably formed from a sheet plastic material such as Dartex P338 Cromarty polyurethane material, commercially sold by Penn Nyla of Nottingham, England. In other applications, urethane based materials, such as nylon 6 warp knitted fabric with a polyurethane transfer coating, or vinyl based or vinyl coated materials, or PVC or polyolefin laminated or coated fabrics or other heat sealable covering materials with antibacterial, antifungal and fluid penetration resistant characteristics can be employed. The seams of covering 60 are preferably heat sealed in a convention manner by radio frequency, thermal or sonic welding or sealed by chemical, adhesive or cement bonding, according to the specific materials used for covering 60 in a given application.

In order to allow internal ventilation between the interior of bedding arrangement 10 and the exterior environment, a vent arrangement 80 is provided at one end of mattress portion 20, preferably adjacent pillow portions 40. In especially preferred embodiments, that vent arrangement includes a plurality of stacked discs which permit air to readily flow into and out of covering 60, but restrict the flow of fluids, such as water and oil, articles, debris and insects into the interior of the bedding arrangement. The materials used for these discs are also preferably puncture resistant when used in stacked relation.

One such suitable vent arrangement would include an exteriorly exposed vinyl or urethane coated polyester screen disc 82, backed by a hydrophobic/oleophobic miro porous membrane disc 84, backed by an interiorly exposed vinyl or urethane coated polyester screen disc 86, backed by a polyurethane adhesive washer 88. More specifically, Textilene material commercially sold by Unitex of Central Falls, R.I. has been found suitable for discs 82 and 86 in preferred embodiments. Versipor membrane material commercially sold by Pall Specialty Materials of Port Washington, N.Y. has been found suitable for disc 84 in preferred embodiments. Polyurethane film washers commercially sold by Bemis Asso., Inc. of Shirly, Mass. have been found suitable for washer 88 in preferred embodiments. Other materials having, alone or in combination, a breathable barrier while blocking undesirable intrusions can be used in specific applications.

In preferred embodiments, the stack of discs in vent arrangement 80 is aligned with and closes an opening 62 in cover 60. For example, when opening 62 is formed to be 1 inch in diameter, the stack of discs is preferably formed to be 1.25 inch in diameter and heat sealed about the outermost 0.25 inch of its diameter against the portion of cover 60 adjacent opening 62. Thus, vent arrangement 80 would be securely positioned onto cover 60 and permit ventilation only through the discs and not about the disc peripheries.

In function, disc 82, being directly exposed to the exterior environment, includes screen openings large enough to allow air to pass freely therethrough, but forms a primary barrier to resist larger insects, articles, debris and puncture. Disc 82 also serves to positively locate and at least partially shield disc 84 from damage. Disc 84 is, for example, micro porous to allow air to flow through it in either direction, but resists the flow of fluids, such as water, blood, oil and the like, at least in a direction toward the interior of cover 60. Disc 84 also serves to resist the entry of smaller insects which might pass through disc 82. Interiorly positioned disc 86 includes screen openings large enough to allow air to pass freely therethrough, but forms a primary barrier to resist abrasive damage to disc 84 from contact with the interior materials of the bedding arrangement. Further, in stacked relation with disc 82, this interior disc also provides resistance to puncture damage from the exterior environment.

As will now be readily understood, the present invention provides numerous advantages over the prior art. Using the example of a correctional institution application, bedding arrangement 10 of the present invention is a comfortable, fully supportive, one piece unit with no separable pillow to be misused, no seams to unravel, and no thread to remove. Incisions to the interior are resisted, but readily detectable if they do occur, such that hidden contraband can be more easily located. By appropriate selection of fluid resistant material for cover 60, the entire exterior of the bedding arrangement can be easily cleaned and disinfected and the interior padding material only minimally exposed to contamination and deterioration. Mounting two pillow portions 40 on opposite sides of mattress portion 20 allows the useful life of the overall unit to be extended merely by reversing the unit, flipping the bedding arrangement over to use the other side.

The present invention thus provides a longer unit life cycle with reduced cycle costs once procured. Additionally, since only a single element is needed with pillow/mattress integration, the procurement costs themselves are reduced. Further, the slim, one piece structure of the present invention minimizes handling costs and inventory space needed for storage and replacement units.

In alternative embodiments customized for particular applications, covering 60 can be formed from materials that resist fire and/or abrasion as well. Covering 60 can also be formed from stretchable and/or shape conforming material and secure the padding materials in place by envelope, gusseted or zipper style construction.

Figure 6:
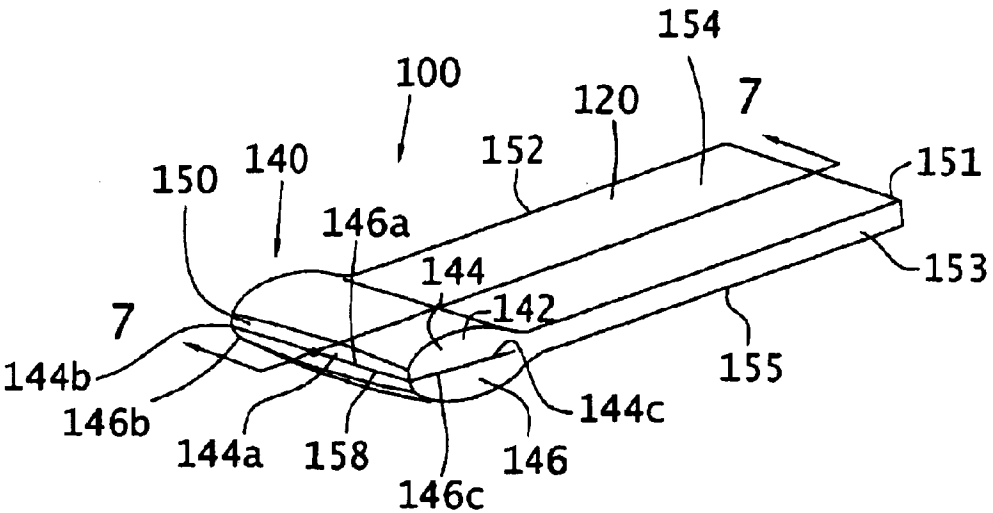
FIG. 6 shows a perspective view of a second embodiment of a bedding arrangement according to the present invention.
Figure 7:
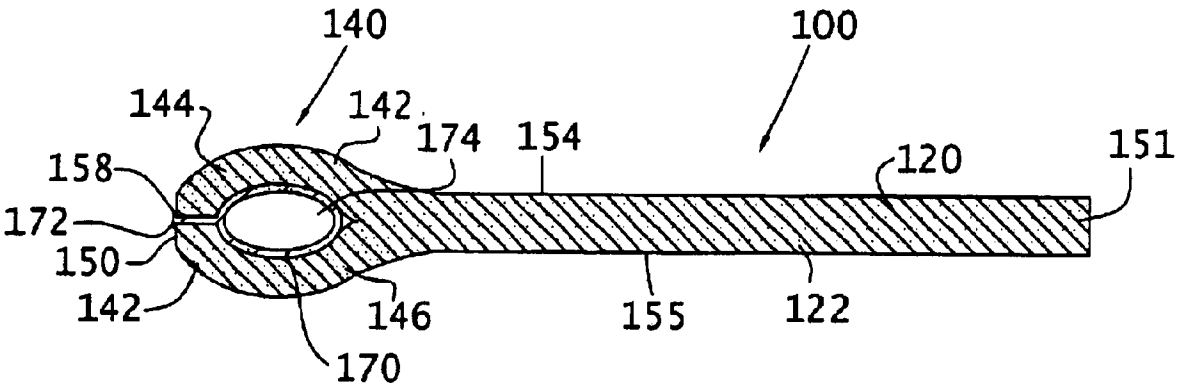
FIG. 7 is a cross-sectional side view of the bedding arrangement of FIG. 6 taken along lines 7—7.

A second embodiment of a bedding arrangement or reversible padded mattress is shown generally as 100 in FIGS. 6 and 7. The reversible padded mattress includes an elongate mattress portion 120 and a pillow portion generally indicated as 140 having a first pillow portion 144 and a second pillow portion 146. The first pillow portion 144 and second pillow portion 146 include edges 144*a*, 146*a*, respectively, and side edges 144*b*, 144*c* and 146*b*, 146*c*, respectively. The elongate mattress portion 120 and pillow portion 140 may both be made from a padding material 122 and 142, respectively. The padding material may be any of those discussed above regarding bedding arrangement 10 or any other suitable padding material.

The bedding arrangement 100 also includes a first end 150, a second end 151, a pair of side ends 152, 153 and a top planar surface 154 and a bottom planar surface 155. It should be noted that edges 144*a*, 146*a* of pillow portions 144 and 146, respectively, extend coincident the first end 150. Furthermore, side edges 144*b*, 146*b* extend along a portion of side end 152, and side edges 144*c*, 146*c* extend along a portion of side end 153. Bedding arrangement 100 also includes a slit 158 formed between the first pillow portion 144 and the second pillow portion 146.

In this embodiment, bedding arrangement 100 includes a spacer or inflatable bladder 170 to provide separation of the first pillow portion 144 and the second pillow portion 146 about slit 158 to form an enclosure or opening 174 therein. The inflatable bladder 170 may be made from any well known flexible air impervious material such as is used for inflatable sport balls. The inflatable bladder may be sealed after being inflated with air or other gaseous or fluid material, or a valve 172, as is well known, may be attached thereto to allow for adjusting the pressure in the bladder.

To assemble bedding arrangement 100, padding material 122 is sliced at the first end 150 and between side ends 152, 153 for a distance approximate the depth of pillow portion 140 to form slit 158. Inflatable bladder 170 is inflated to the desired level and placed in slit 158 between the first pillow portion 144 and second pillow portion 146. The inflatable bladder may be sized such that edges 144*a*, 144*b*, 144*c* of the first pillow portion 144, may be joined or adhered to the respective edges 146*a*, 146*b*, 146*c* of the second pillow portion 146 using a suitable adhesive or other joining means.

If bedding arrangement 100 contains a valve 172, then the firmness of the pillow portion 140 may be adjusted by inflating or deflating inflatable bladder 170 to the desired level. A covering (not shown) such as covering 60 shown and described for bedding arrangement 10 may also be placed around bedding arrangement 100 for wear and moisture resistance. As with bedding arrangement 10, this embodiment provides a lightweight reversible mattress.

Figure 8:
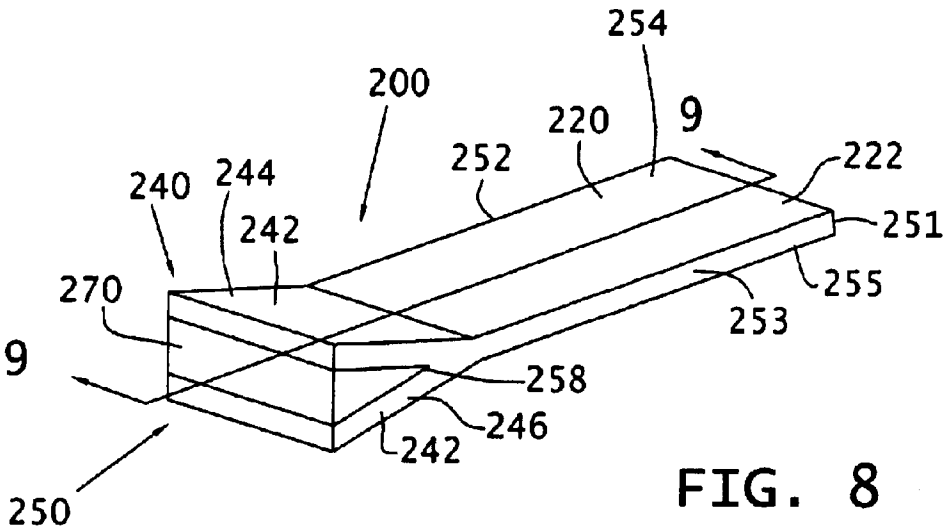
FIG. 8 shows a perspective view of a third embodiment of a bedding arrangement according to the present invention.
Figure 9:
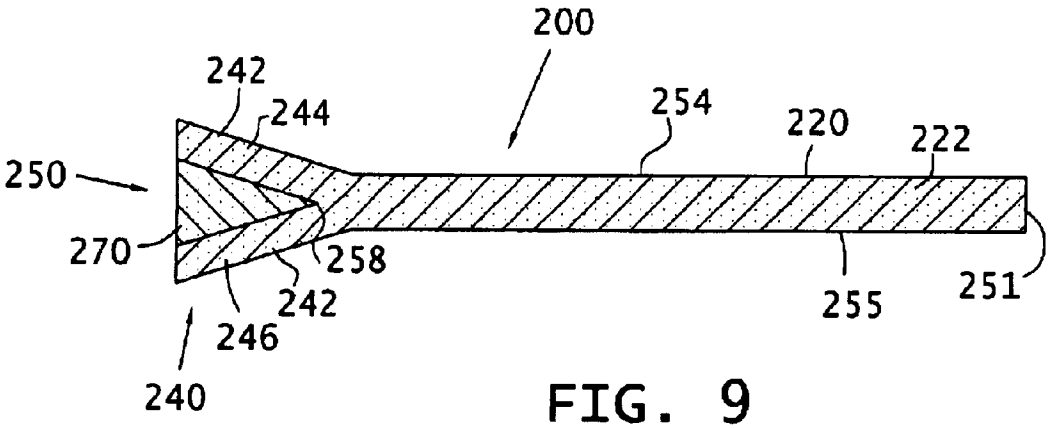
FIG. 9 shows a cross-sectional side view of the bedding arrangement of FIG. 8 taken along lines 9—9.

Now referring to FIGS. 8 and 9, a third embodiment of a bedding arrangement or reversible padded mattress is shown generally as 200. Reversible padded mattress 200 includes an elongate mattress portion 220 and a pillow portion generally indicated as 240. Elongate mattress portion 220 may be formed from a padding material 222 and pillow portion 240 of a padding material 242. Additionally, pillow portion 240 is split and separated into a first pillow portion 244 and a second pillow portion 246 about a slit 258.

Reversible padded mattress 200 also includes a first end generally indicated as 250, a second end 251, a pair of side ends 252, 253, a top planar surface 254 and a bottom planar surface 255. A spacer 270 is located between the first pillow portion 244 and the second pillow portion 246. In the embodiment shown, spacer 270 has a wedge shape and extends to the first end 250 and across the pillow portions to the side ends 252, 253. Spacer 270 may be made from a padding or cushioning material of the same type as padding materials 222 and 242. Alternately, spacer 270 may be made from padding of a different density than padding materials 222 and 242 to provide the desired firmness to pillow portion 240. Spacer 270 may also be made from any other suitable material such as a soft or hollow plastic.

Reversible padded mattress 200 is fabricated by slicing elongate mattress 220 at first end 250 in a direction parallel to top and bottom planar surfaces 254, 255 and then inserting the selected spacer 270 between the first pillow portion 244 and the second pillow portion 246. An adhesive or other means may be used to adhere spacer 270 to the pillow portion to hold it firmly in place.

It should be apparent, that slit 248 need not extend completely across the width of the pillow portions from side ends 252 to 253. Additionally, spacer 270 may be formed in any desired configuration to provide a suitable pillow configuration for pillow portion 240. Reversible padded mattress 200 may also include a cover (not shown) as discussed above.

Figure 10:
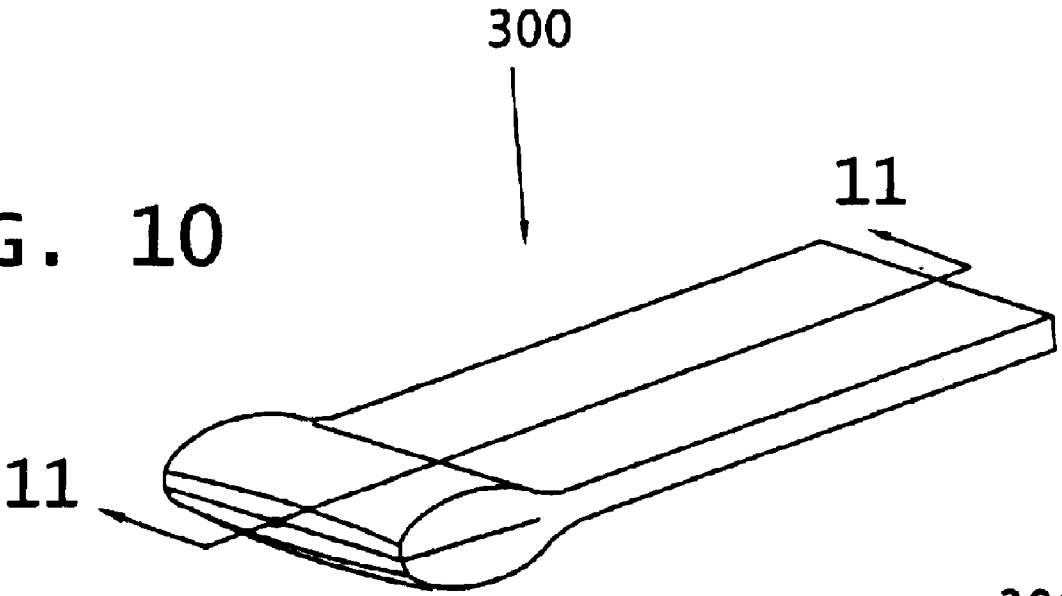
FIG. 10 shows a perspective view of a fourth embodiment of a bedding arrangement according to the present invention.
Figure 11:
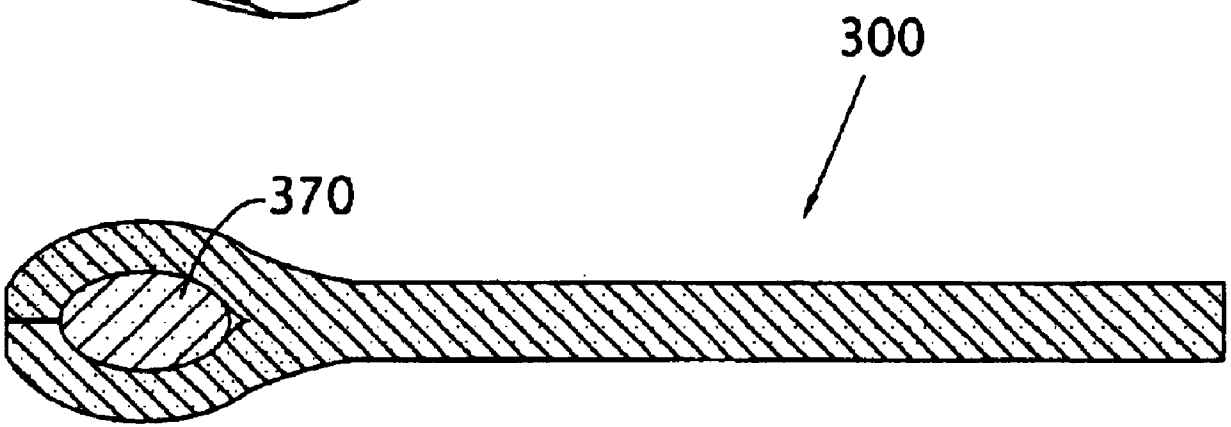
FIG. 11 shows a cross-sectional side view of the bedding arrangement of FIG. 10 taken along lines 11—11.

A fourth embodiment bedding arrangement or reversible padded mattress is shown in FIGS. 10 and 11 and generally indicated as 300. Reversible padded mattress 300 is similar to reversible padded mattress 100 shown in FIGS. 6 and 7 except that reversible padded mattress 300 utilizes a different spacer 370 than the inflatable bladder spacer 170 used in reversible padded mattress 100. Spacer 370 may be made with a cushioning or padding material as with spacer 270 or other suitable materials. Also as discussed, spacer 370 may have a different density than the padding material used for the balance of reversible padded mattress 300. Of course, this embodiment may also include a sealed cover (not shown) for protecting the mattress.

Figure 12:
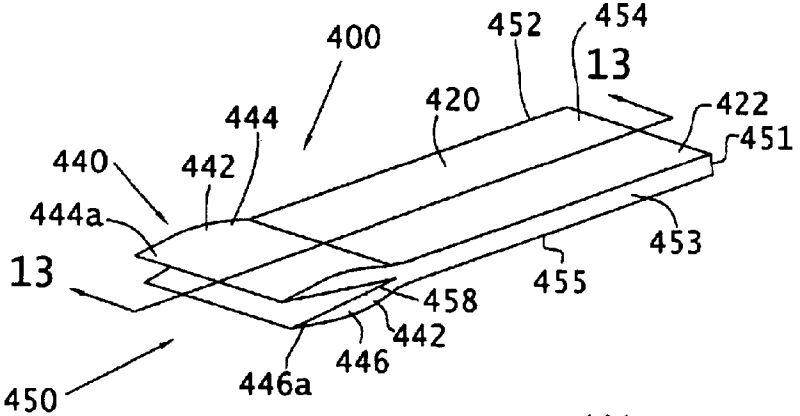
FIG. 12 shows a perspective view of a fifth embodiment of a bedding arrangement according to the present invention in an intermediate stage of fabrication.
Figure 13:
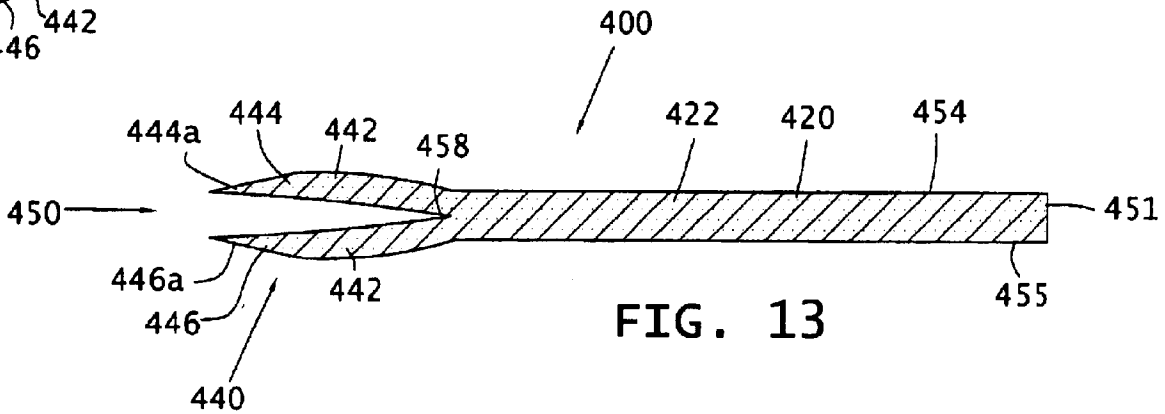
FIG. 13 shows a cross-sectional side view of the bedding arrangement of FIG. 12 taken along lines 13—13.
Figure 14:
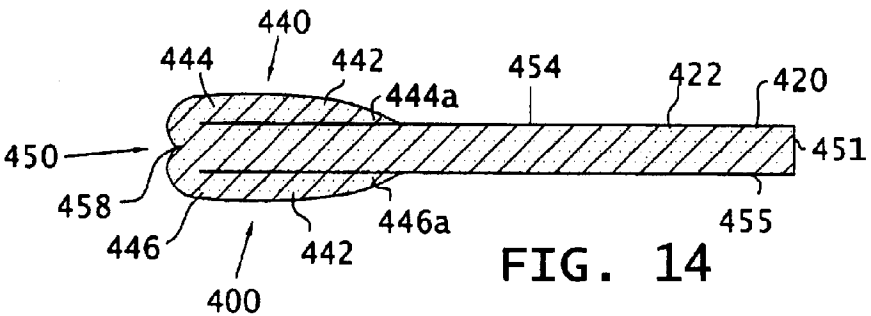
FIG. 14 shows a cross-sectional side view of the bedding arrangement of FIG. 12 taken along the same line as FIG. 13 except that the bedding arrangement is in its final configuration.

Now referring to FIGS. 12–14, a fifth embodiment of a bedding arrangement or reversible padded mattress is shown generally indicated as 400. Reversible padded mattress 400 includes an elongate mattress portion 420 and a pillow portion generally indicated as 440. The elongate mattress portion 420 and pillow portion 440 may be made of a padding material 422, 444, respectively. Pillow portion 440 may include a first pillow portion 444 and a second pillow portion 446. The first and second pillow portions 444, 446 include tapered ends 444*a* and 446*a*, respectively.

Reversible padded mattress 400 also includes a first end generally indicated as 450, a second end 451, a pair of side ends 452, 453, a top planar surface generally indicated as 454 and bottom planar surface generally indicated as 455. A slit 458 is provided in reversible padded mattress 400 to separate the first pillow portion 444 and second pillow portion 446.

To fabricate reversible padded mattress 400, slit 458 is cut in the first end 450 so that the first pillow portion 444 and the second pillow portion 446 may be separated from one another. Next, the pillow portions are folded back along slit 458 until pillow portion 444 is adjacent top planar surface 454 and pillow portion 446 is adjacent bottom planar surface 455 as is shown in FIG. 14. At this point, the innermost portion of slit 458 will coincide with first end 450.

Reversible padded mattress 400 may then be covered with a cover (not shown) to hold the first and second pillow portions 444, 446 in place, or the pillow portions may be joined or adhered to the respective top and bottom planar surfaces 454, 455 of elongate mattress portion 420 using an adhesive or other well known joining means. In this embodiment, the elongate mattress portion 420 serves as a spacer between the pillow portions.

Although certain preferred embodiments of the present invention have been described above in detail, that is only by way of illustration and example. Those of ordinary skill in the art will now appreciate that modifications and adaptations of this invention can be made to many environments of use and that the examples given are frames of reference only and not application specific requirements. Accordingly, the spirit and scope of the present invention are to be limited only by the terms of the claims below.

What we claim is:

1. A reversible padded mattress comprising: an elongate mattress portion of a padding material having a first end an a second end, a pair of side ends, a top surface and a bottom surface; a first pillow portion disposed at said first end and extending above said top surface; a second pillow portion also located at said first end and extending below said bottom surface, said first and said second pillow portions formed integrally with said elongate mattress portion and being slit therebetween so that said first and second pillow portions may be spaced apart; and a covering material substantially surrounding said elongate mattress portion and said pillow portions.

2. The reversible padded mattress as set forth in claim 1, wherein said slit extends completely across a width of said first and second pillow portions.

3. The reversible padded mattress as set forth in claim 1, wherein said slit extends from said first end.

4. The reversible padded mattress as set forth in claim 3, wherein edges of said first pillow portion and said second pillow portion are joined to one another to close said slit across said first end.

5. The reversible padded mattress as set forth in claim 1, including an inflated bladder located between said first and second pillow portions in an opening defined by said slit.

6. The reversible padded mattress as set forth in claim 5, wherein said bladder includes a valve that is accessible for adjusting the amount of air in the bladder to customize the firmness of said pillow portion.

7. The reversible padded mattress as set forth in claim 5, wherein said bladder does not extend completely across a width of said first and second pillow portions, and edges of said first and second pillow portions are joined together along said first end and along said side ends to form an enclosure for said bladder.

8. The reversible padded mattress as set forth in claim 1, wherein a cushioning material is located in said slit to separate said first and second pillow portions.

9. The reversible padded mattress as set forth in claim 8, wherein said cushioning material has a wedge shape.

10. The reversible padded mattress as set forth in claim 8, wherein said cushioning material is adhered to at least one said first and second pillow portions.

11. The reversible padded mattress as set forth in claim 8, wherein said cushioning material has a different density than said padding material of said elongate mattress portion.

12. The reversible padded mattress as set forth in claim 8, wherein edges of said first and second pillow portions are joined to one another at said first end and along said side ends at said slit to form an enclosure for said cushioning material.

13. The reversible padded mattress as set forth in claim 1, wherein said first and second pillow portions are folded back with said first pillow portion adjacent said top surface and said second pillow portion adjacent said bottom surface of said elongate mattress portion.

14. The reversible padded mattress as set forth in claim 13, wherein said first and second pillow portions include tapered ends, said tapered ends being adhered to said respective top surface and said bottom surface of said elongate mattress portion.

15. The reversible padded mattress as set forth in claim 13, wherein an innermost portion of said slit is located at said first end of said elongate mattress portion after said pillow portions are folded thereabout.

16. A method of manufacturing padded mattress, comprising the steps of: providing a substantially rectangular mattress portion of a padding material, with said mattress portion having a first end, a second end, a pair of side ends, a top planar surface and a bottom planar surface; slitting said padding material towards said first end to form a first pillow portion and a second pillow portion of said padding material; and separating said first and second pillow portions so that said first pillow portion extends above said top planar surface and said second pillow portion extends below said bottom planar surface.

17. The method of manufacturing a padded mattress as set forth in claim 16, wherein said padding material for said mattress portion and said first and second pillow portions is provided as a batting material.

18. The method of manufacturing a padded mattress as set forth in claim 16, further including the steps of: providing a spacer, and inserting said spacer between said first and second pillow portions to provide the separation therebetween.

19. The method of manufacturing a padded mattress as set forth in claim 18, wherein said spacer is formed from a padding material.

20. The method of manufacturing a padded mattress as set forth in claim 16, further including the step of adhering said spacer to at least one of said first and second pillow portions.

21. The method of manufacturing a padded mattress as set forth in claim 18, wherein said spacer is an inflatable bladder.

22. The method of manufacturing a padded mattress as set forth in claim 18, including the step of joining edges of said first and second pillow portions together at said top end and said side ends to enclose said spacer within said pillow portions.

23. The method of manufacturing a padded mattress as set forth in claim 16, further including the step of: folding said first and second pillow portions back along the slit.

24. The method of manufacturing a padded mattress as set forth in claim 23, including the steps of: adhering said first pillow portion to said top planar surface and adhering said second pillow portions to said bottom planar surface.

25. The method of manufacturing a padded mattress as set forth in claim 16, including the steps of: providing a sheet covering material, and surrounding said pillow portions and said mattress portion with said sheet covering material.

26. A padded mattress comprising: a mattress portion of a padding material having a first end, a second end, a pair of side ends, a top surface and a bottom surface; a first pillow portion disposed at said first end; a second pillow portion also disposed at said first end, said first and said second pillow portions being integral extensions of said padding material of said mattress portion, said first and second pillow portions being at least partially spaced apart so that said pillow portions extend beyond at least one of said top surface or of said bottom surface in a direction perpendicular to said surfaces.

27. The padded mattress as se forth in claim 26, further including a spacer located between said first and second pillow portions to provide the separation therebetween.

28. The padded mattress as set forth in claim 27, wherein said spacer includes an inflatable bladder.

29. The padded mattress as set forth in claim 27, wherein said spacer is formed from a padding material.

30. The padded mattress as set forth in claim 29, wherein said padding material of said spacer is of a different density than said padding material of said mattress portion.

31. The padded mattress as set forth in claim 27, wherein said spacer has a wedge shape.

32. The padded mattress as set forth in claim 27, wherein edges of said first and second pillow portions are joined to one another at said first end and along said side ends to form an enclosure for said spacer.

33. The padded mattress as set forth in claim 26, wherein said first and second pillow portions are folded back about said mattress portion so that said first pillow portion is adjacent said top surface and said and pillow portion is adjacent said bottom surface of said mattress portion.

34. The padded mattress as set forth in claim 33, wherein said first and second pillow portions include tapered ends, said tapered ends being adhered to said respective top surface and said bottom surface of said mattress portion.

35. The padded mattress as set forth in claim 26, further including a covering material substantially surrounding and sealingly encasing said mattress portion and said pillow portion.

* * * * *